US008041071B2

(12) United States Patent
Furuto et al.

(10) Patent No.: US 8,041,071 B2
(45) Date of Patent: Oct. 18, 2011

(54) DIAPHRAGM AND SPEAKER DEVICE

(75) Inventors: Akihiko Furuto, Tendo (JP); Sinsuke Konuma, Tendo (JP)

(73) Assignees: Pioneer Corporation, Toyko (JP); Tohoku Pioneer Corporation, Yamagata (JP)

( * ) Notice: Subject to any disclaimer, the term of this patent is extended or adjusted under 35 U.S.C. 154(b) by 341 days.

(21) Appl. No.: 12/521,048

(22) PCT Filed: Dec. 27, 2006

(86) PCT No.: PCT/JP2006/326039

§ 371 (c)(1),
(2), (4) Date: Jun. 24, 2009

(87) PCT Pub. No.: WO2008/081503

PCT Pub. Date: Jul. 10, 2008

(65) Prior Publication Data

US 2010/0135520 A1 Jun. 3, 2010

(51) Int. Cl.

| | |
|---|---|
| ***H04R 1/00*** | (2006.01) |
| ***H04R 9/06*** | (2006.01) |
| ***H04R 11/02*** | (2006.01) |

(52) U.S. Cl. ..... 381/400; 381/398; 381/429

(58) Field of Classification Search ..... 381/386, 381/396, 398, 400, 403, 404, 429, 433; 181/157, 181/173, 198, 199

See application file for complete search history.

(56) References Cited

U.S. PATENT DOCUMENTS

2007/0140520 A1* 6/2007 Konuma et al. ..... 381/400
2007/0147651 A1* 6/2007 Mitobe et al. ..... 381/396

FOREIGN PATENT DOCUMENTS

JP 11-187484 7/1999
JP 2002-078079 3/2002

OTHER PUBLICATIONS

International Search Report, PCT/JP2006/326039, Mar. 27, 2007.

* cited by examiner

*Primary Examiner* — Tuan Nguyen
(74) *Attorney, Agent, or Firm* — Young & Thompson

(57) ABSTRACT

A diaphragm and a speaker unit which can prevent generation of abnormal sound by suppressing rolling phenomenon. The speaker unit has a diaphragm. The diaphragm includes a portion for supporting a voice coil, and a sound emitting portion formed continuously to one end thereof. The voice coil supporting portion has a shape extending reversely to the sound emitting direction. The sound emitting portion includes a step portion having a surface substantially perpendicular to the sound emitting direction, and a bent portion having a cross-section bent toward the inside of the voice coil supporting portion from one end of the step portion. Consequently, the voice coil supporting portion is movable to describe an arc having a radius substantially equal to the radius of curvature at the bent portion of the voice coil supporting portion and a basic point substantially identical to the center of the bent portion in the bending direction as the voice coil moves in the sound emitting direction or in the reverse direction. Rolling phenomenon can thereby be retarded, the voice coil supporting portion can be prevented from colliding against a magnetic circuit when the speaker unit is driven and generation of abnormal sound can be prevented.

5 Claims, 5 Drawing Sheets

DIAPHRAGM AND SPEAKER DEVICE

TECHNICAL FIELD

The present invention relates to a configuration of a diaphragm in a speaker device which can be preferably used for a mobile equipment and the like.

BACKGROUND TECHNIQUE

Conventionally, there is known a riffel-type speaker configured to include a rectangular diaphragm and a linear voice coil arranged at the center of the diaphragm. For example, a speaker having a configuration of this kind is disclosed in a Patent Reference 1.

The speaker disclosed in the Patent Reference 1 includes: an upper and a lower magnetic circuits providing magnetic gaps parallel with each other and having opposite magnetic flux directions; a frame connected to the magnetic circuits and having an U-shaped section; a diaphragm supporting a voice coil substantially at its center and having an outer circumference supported by the frame; and a damper arranged below the voice coil and having an outer circumference attached to the frame. By this configuration, the minimum resonance frequency f0 can be lowered even if an elongated configuration with a narrow lateral width is employed, thereby improving the sound pressure characteristic.

Patent Reference 1: Japanese Patent Application Laid-open under No. H11-187484

DISCLOSURE OF INVENTION

Problem Solved by the Invention

In the speaker device disclosed in the Patent Reference 1, since the voice coil is supported by the diaphragm, it is understood that the supporting power of the voice coil in the sound radiating direction is large. On the other hand, since the sides of the voice coil are not supported, it is understood that the supporting power of the voice coil in a direction substantially perpendicular to the sound radiating direction (i.e., the direction of the magnetic flux in the magnetic gap) is not so large. Therefore, when the speaker is driven, the vibrating body including the voice coil and the diaphragm easily rolls along the magnetic flux direction (Rolling phenomenon).

Therefore, when the rolling phenomenon occurs in this speaker, there is a problem that the voice coil collides with the magnet and the plate forming the magnetic circuit due to the rolling phenomenon, and abnormal sound is generated.

In this speaker, the voice coil is connected to the diaphragm. Therefore, there is a problem that, when the voice coil, the center (corresponding to the voice coil bobbin) and the diaphragm are regarded as the vibrating body, the stiffness of the vibrating body itself is poor. Also, there is a problem that, when the voice coil is attached to the diaphragm, it is necessary to attach the voice coil to the diaphragm after reversing the diaphragm once, thereby making the attaching operation difficult.

The above is an example of the problems that the present invention will solve. It is an object of this invention to provide a speaker device capable of preventing the generation of abnormal sound by suppressing the rolling phenomenon, improving the output sound pressure level and lowering the minimum resonance frequency f0.

Means for Solving the Problem

According to the invention of claim 1, a diaphragm comprises: a voice coil supporting part which supports a voice coil; and a sound radiating part formed to be connected to an end of the voice coil supporting part, wherein the voice coil supporting part has a shape extending in a direction opposite to a sound radiating direction, and wherein the sound radiating part comprises a stepped part having a face substantially perpendicular to the sound radiating direction, and a curving part having a curving sectional shape curving from an end of the stepped part toward an inside of the voice coil supporting part.

Figure 1:
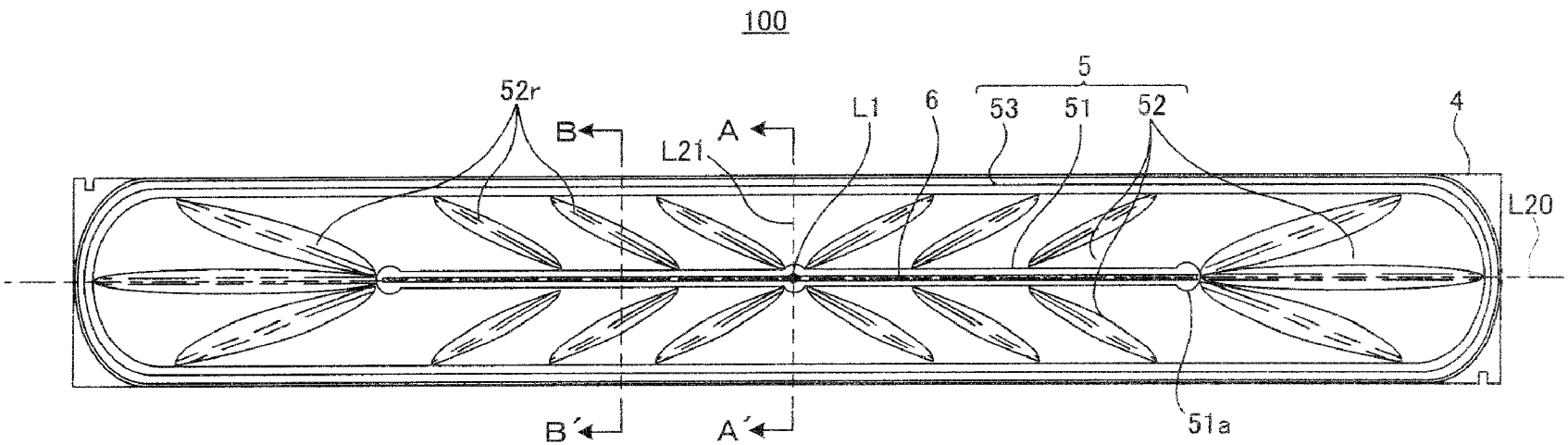
FIG. 1 is a front view of a speaker device according to an embodiment of the present invention.

| BRIEF DESCRIPTION OF THE REFERENCE NUMBER | |
|---|---|
| 5 | Diaphragm |
| 6 | Voice coil |
| 30 | Magnetic circuit |
| 31 | Vibrating body |
| 70a | First magnetic gap |
| 70b | Second magnetic gap |
| 51 | Voice coil supporting part |
| 52 | Sound radiating part |
| 52a | Top part |
| 52c | Stepped part |
| 52d | Curving part |
| 52x | Inner circumferential edge |
| 52r | Reinforcing rib |
| 53 | Attaching part |
| 100 | Speaker device |
| 800, 900 | Mobile phone |

BEST MODE TO EXECISE THE INVENTION

According to one aspect of the present invention, there is provided a diaphragm comprising: a voice coil supporting part which supports a voice coil; and a sound radiating part formed to be connected to an end of the voice coil supporting part, wherein the voice coil supporting part has a shape extending in a direction opposite to a sound radiating direction, and wherein the sound radiating part comprises a stepped part having a face substantially perpendicular to the sound radiating direction, and a curving part having a curving sectional shape curving from an end of the stepped part toward an inside of the voice coil supporting part.

The above diaphragm includes a voice coil supporting part which supports a voice coil, and a sound radiating part formed to be connected to an end of the voice coil supporting part. The voice coil supporting part has a shape extending in a direction opposite to a sound radiating direction.

Particularly, in the diaphragm, the sound radiating part includes a stepped part having a face substantially perpendicular to the sound radiating direction, and a curving part having a curving sectional shape curving from an end of the stepped part toward an inside of the voice coil supporting part.

Thereby, in the diaphragm, the movable range of the voice coil supporting part is defined by the stepped part and the curving part. Thus, when the diaphragm vibrates, the substantial center of the curving part in the curving direction serves as the origin of the movement of the voice coil. Also, when the voice coil moves in the sound radiating direction or its opposite direction, the voice coil supporting part is movable by drawing an arc with using the radius of curvature of the curving part of the voice coil supporting part as the substantial radius and with using the substantial center in the curving direction of the curving part as the origin. Therefore, even if rolling phenomenon occurs in the diaphragm, it becomes possible to reduce the rolling width of the voice coil supporting part and to suppress the rolling phenomenon, thereby making rolling phenomenon hardly occur. As a result, in the speaker device including the diaphragm and the magnetic circuit and in which the voice coil supporting part is positioned at the center of the magnetic circuit, it can be prevented that the voice coil supporting part collides with the magnetic circuit, and the generation of abnormal sound can be avoided.

In one manner of the above diaphragm, the sound radiating part has a shape curving toward the sound radiating direction, and an attaching part to be attached to an attached part is provided at an outer circumferential end of the sound radiating part, and a top of the sound radiating part is positioned outside of a center of the sound radiating part.

By this, the effective vibrating area (the area of the sound radiating part substantially contributing to the vibration) in the diaphragm becomes large, and the output sound pressure level can be larger. In addition, the compliance (an inverse number of the stiffness of the diaphragm) becomes large, and the minimum resonant frequency f0 can be lowered.

In another manner of the above diaphragm, the sound radiating part has a shape including a long axis and a short axis, and a reinforcing rib is formed on the sound radiating part from one of the long axis and the short axis toward an outer circumferential end of the sound radiating part. In a preferred example, the reinforcing rib has a shape depressed in the sound radiating direction or its opposite direction.

By this, the compliance of the diaphragm in the vibrating direction (sound radiating direction) of the diaphragm becomes large, and the minimum resonance frequency F0 can be lowered. Also, the stiffness of the diaphragm becomes large, and the rolling phenomenon can be suppressed.

According to another aspect of the present invention, there is provided a mobile equipment (for example, a mobile phone) including the above speaker device.

EMBODIMENT

The preferred embodiment of the present invention will now be described below with reference to the attached drawings.

[Configuration of Speaker Device]

The configuration of the speaker device 100 according to the embodiment of the present invention will be described with reference to FIGS. 1 and 2.

Figure 2:
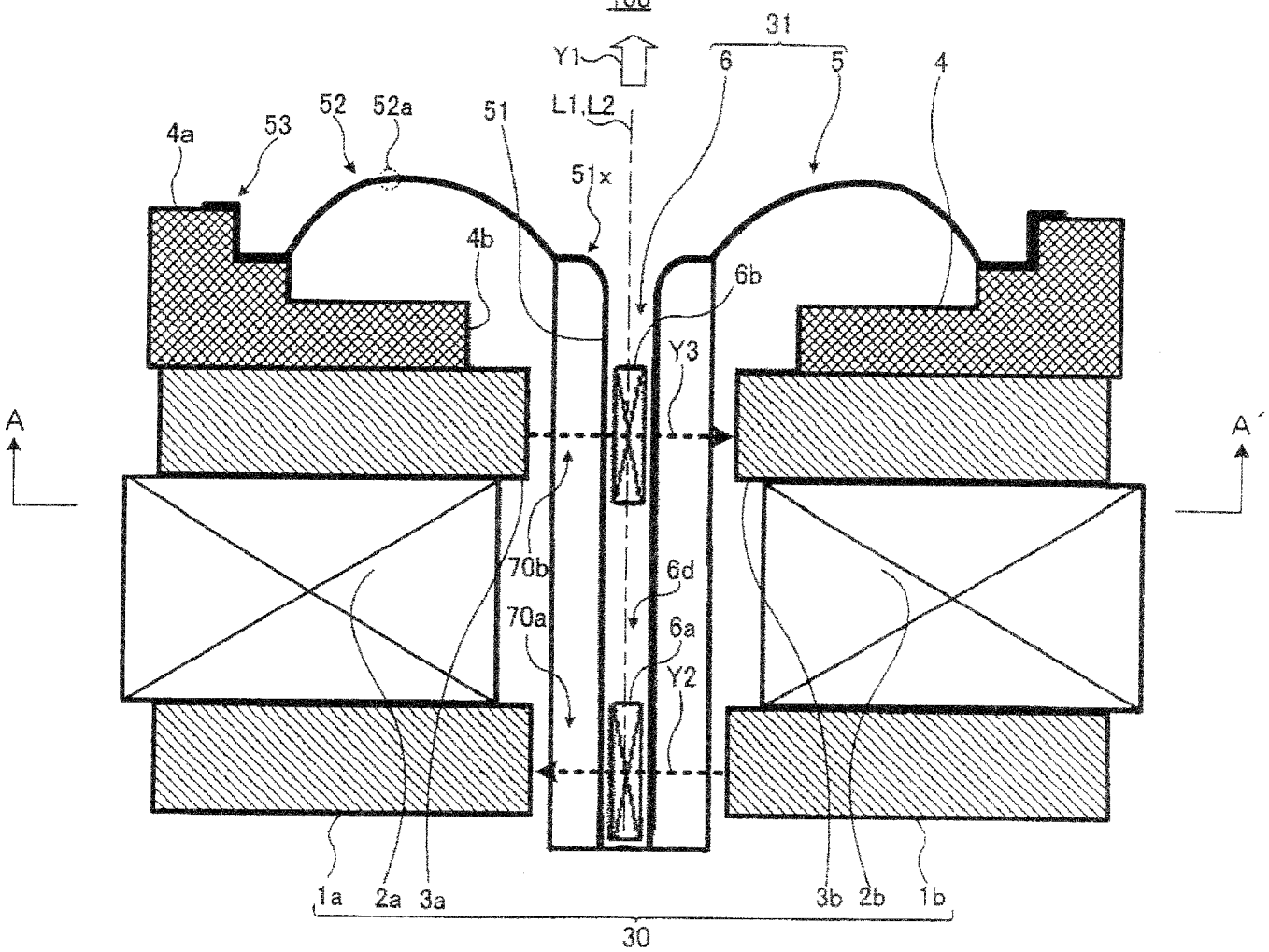
FIG. 2 is a sectional view of the speaker device according to the embodiment.

FIG. 1 is a front view of the speaker device 100 according to the embodiment of the present invention. FIG. 2 is a sectional view of the speaker device 100 cut along the cutting plane line A-A' shown in FIG. 1, and particularly shows the sectional view of the speaker device 100 cut at the position passing through the central axis L1 thereof.

The speaker device 100 is preferably used as a speaker for a mobile equipment or a micro-speaker. The speaker device 100 mainly includes an internal-magnet type magnetic circuit 30 including a pair of first plates 1*a* and 1*b*, a pair of magnets 2*a* and 2*b*, and a pair of second plates 3*a* and 3*b*; a vibrating body 31 including a diaphragm 5 and a voice coil 6; and a frame 4 supporting the magnetic circuit 30 and the vibrating body 31. In the following description, each magnet and each of the first or second plate are expressed as the magnet 2*a* or the first plate 1*a* when they are distinguished from each other, and are expressed as the magnet 2 or the first plate 1 when they are not distinguished from each other.

(Configuration of Magnetic Circuit)

The magnetic circuit 30 includes, as its constitutional elements, a pair of first plates 1*a* and 1*b*, a pair of magnets 2*a* and 2*b*, and a pair of second plates 3*a* and 3*b*. The configuration of each of the constitutional elements will be described below.

Each of the pair of the first plates 1*a* and 1*b* has a shape of substantially rectangular parallelepiped and rectangular stick, and they are arranged in a manner opposing to each other with a predetermined distance therebetween. A first magnetic gap 70*a* is formed between the first plate 1*a* and the first plate 1*b*. The direction of the magnetic flux generated in the first magnetic gap 70*a* is set to the direction of the arrow Y2, for example.

Each of the pair of the magnets 2*a* and 2*b* has a shape of substantially rectangular parallelepiped and rectangular stick, and they are attached to the upside of the each of the pair of the first plates 1*a* and 1*b* in a manner opposing to each other with a predetermined distance therebetween.

The pair of the second plates 3*a* and 3*b* has a shape of substantially rectangular parallelepiped and rectangular stick. The pair of the second plates 3*a* and 3*b* is arranged in a manner opposing to each other with a predetermined distance therebetween. The second plate 3*a* is attached to the upside of the magnet 2*a*, and the second plate 3*b* is attached to the upside of the magnet 2*b*. A second magnetic gap 70*b* is formed between the second plate 3*a* and the second plate 3*b*. The direction of the magnetic flux generated within the second magnetic gap 70*b* is opposite to the direction of the magnetic flux generated in the first magnetic gap 70*a*. The magnitudes of the magnetic forces generated in the second magnetic gap 70*b* and the first magnetic gap 70*a* are relatively and substantially equal to each other. In FIG. 2, as the direction of the magnetic flux, the direction of the magnetic flux in the first magnetic gap 70*a* is shown by the arrow 12, and the direction of the magnetic flux in the second magnetic gap 70*b* is shown by the arrow Y3.

(Configuration of Vibrating Body)

The vibrating body 31 includes, as its constitutional elements, the diaphragm 5 and the voice coil 6. The configuration of each of the constitutional elements will be described below.

The diaphragm 5 has an outer shape having linear parts confronting with each other and curving parts confronting with each other. The diaphragm 5 has an elongated outer shape defined by a long axis L20 and a short axis L21, and includes a voice coil supporting part 51 for supporting the voice coil 6, a sound radiating part 52 having a role of radiating sound wave and an attaching part 53 to be attached to an attached part 4*a* of the frame 4 described later.

The voice coil supporting part 51 is arranged at a center in the direction of the short axis L21 of the diaphragm 5 and at the inside of the sound radiating part 52. The voice coil supporting part 51 has a shape which extends in the direction opposite to the sound radiating direction Y1 and has an elongated shape extending in the direction of the long axis L20. Also, the voice coil supporting part 51 has a bag-like or concave sectional shape. The voice coil supporting part 51 has a gap of a predetermined width in the direction of the short axis L21, and the gap creates a space of rectangular parallelopiped shape. It is preferred that the width of the gap is set to a value as narrow as possible in order to increase the magnetic flux density, and it is set to approximately 0.2 mm, for example. The voice coil supporting part 51 has bulge parts 51*a* in the direction of the long axis L20 with a predetermined interval, and the bulge part 51*a* has a width larger than that of the width of the gap. The gap of the bulge part 51*a* creates a space of substantially column shape. Thereby, the stiffness of the voice coil supporting part 51 can be large. The sound radiating part 52 is formed to extend from one end (outer circumferential end) of the voice coil supporting part 51, and has a shape of curving toward the sound radiating direction Y1. The attaching part 53 is formed at the outer circumferential end of the sound radiating part 52. The diaphragm 5 having the above-described basic configuration is supported by the frame 4 in such a manner that the voice coil supporting part 51 is arranged at the center of the magnetic circuit 30 and the attaching part 53 is attached to the attached part 4*a* of the frame 4. The characteristic configuration of the diaphragm 5 according to the embodiment of the present invention will be described later.

The voice coil 6 has a pair of plus and minus lead wires (not shown), and is wound to form a shape of elongated and annular plane shape. The voice coil 6 has a first parallel part 6*a* and a second parallel part 6*b* arranged in parallel with each other. The first parallel part 6*a* extends in one direction, and the second parallel part 6*b* is arranged to confront with the first parallel part 6*a* with a constant gap 6*d* therebetween. The voice coil 6 is arranged in the voice coil supporting part 51 and supported by the voice coil supporting part 51. The first parallel part 6*a* is positioned in the first magnetic gap 70*a*, and the second parallel part 6*b* is positioned in the second magnetic gap 70*b*.

The plus lead wire of the voice coil 6 is an input cable for the L(or R) channel signal, and the minus lead wire is an input cable for a ground (GND) signal. Each of the lead wires is electrically connected to the output cable on the side of an amplifier not shown. Thus, the signal and the electrical power (hereinafter simply referred to as "sound current") are inputted to the voice coil 6 via the lead wires from the amplifier side. Since the sound current orbitally flows in the voice coil 6, the direction of the sound current flowing in the first parallel part 6*a* is relatively opposite to the direction of the sound current flowing in the second parallel part 6*b*.

(Configuration of Frame)

The frame 4 has an elongated shape surrounding the sound radiating part 52 of the vibrating body 31. In a preferred example, the frame 4 is formed with resin material easy to mold and process. The frame 4 has the attached part 4*a*, at its upper end, to which the outer circumference (attaching part) 53 of the diaphragm 5 is attached. Also, the frame 4 has an elongated opening 4*b*, at its center, into which the voice coil supporting part 51 of the diaphragm 5 is inserted.

In the speaker device 100 having the above-described configuration, the sound current outputted from the amplifier is inputted to the voice coil 6 via the pair of plus and minus lead wires, and thus the sound current flows through the voice coil 6. When the sound current flows through the voice coil 6, electromagnetic force (Lorentz's force) acts on the first parallel part 6*a* of the voice coil 6 in the first magnetic gap 70*a*, and electromagnetic force (Lorentz's force) acts on the second parallel part 6*b* of the voice coil 6 in the second magnetic gap 70*b*. When this electromagnetic force serves as the driving force of the voice coil 6 and the driving force is applied to the diaphragm 5, the diaphragm 5 moves in the sound radiating direction Y1 or its opposite direction, and the sound wave is radiated from the sound radiating part 52 of the diaphragm 5 in the sound radiating direction Y1.

(Configuration of Diaphragm)

Next, the characteristic configuration of the diaphragm 5 according to the embodiment of the present invention will be described with reference to FIG. 3.

Figure 3:
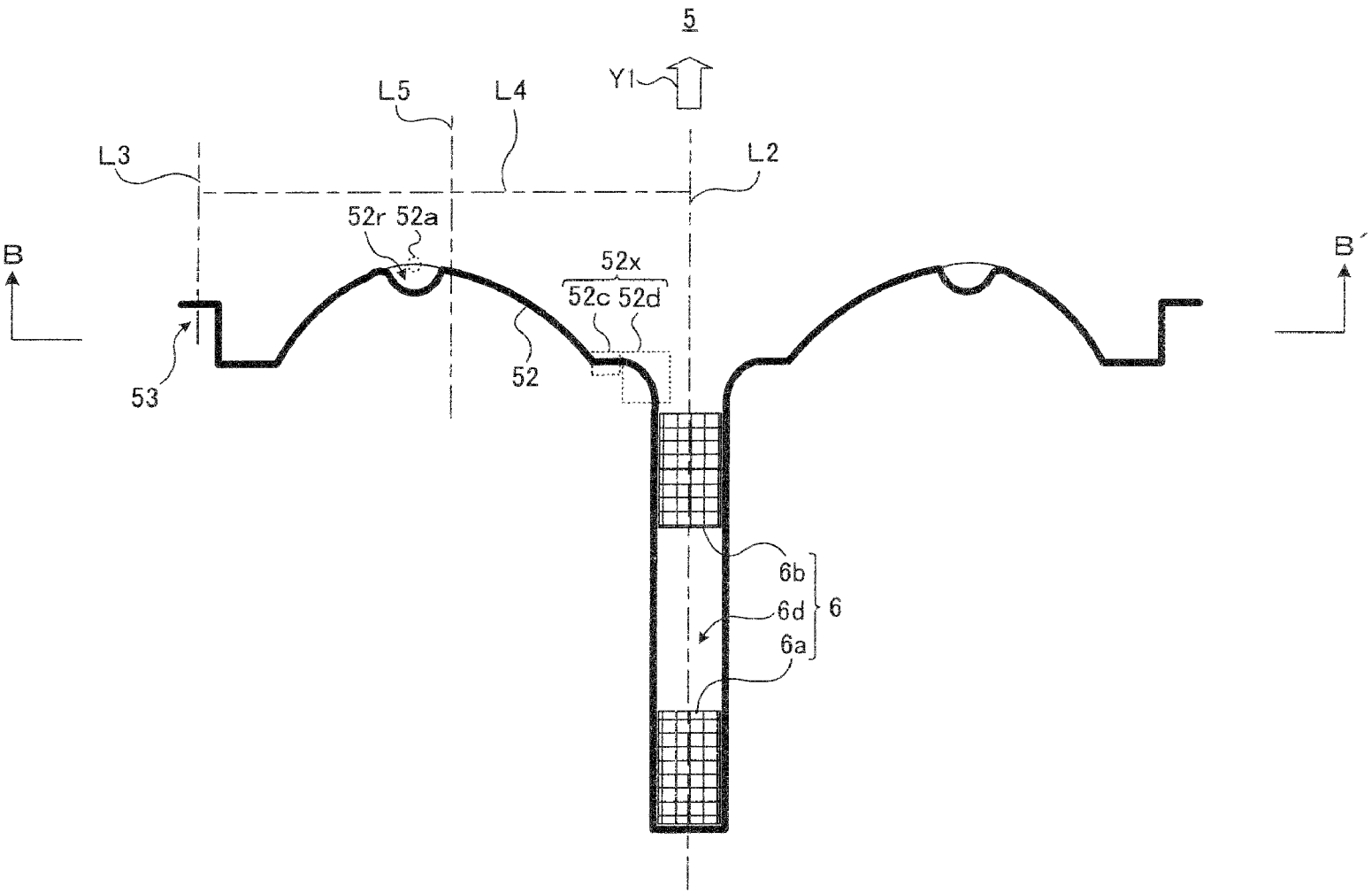
FIG. 3 is a sectional view of a diaphragm according to the embodiment.

FIG. 3 is a sectional view of the diaphragm 5 cut along the cutting plane line B-B' shown in FIG. 1 and is a sectional view of the diaphragm 5 along the direction of the short axis L21.

The basic configuration of the diaphragm 5 has already been described, and particularly the inner circumferential side of the sound radiating part 52 has a characteristic shape in this embodiment.

Specifically, the sound radiating part 52 has, at its inner circumferential side 52*x*, a stepped part 52*c* (surrounded by the broken line) having a face substantially perpendicular to the sound radiating direction Y1, and a curving part 52*d* (surrounded by the broken line) having a curving shape, in section, curving from one end (inner circumferential side) of the stepped part 52*c* toward the inner side (the central axis L2 side) of the voice coil support part 51.

By this configuration, in this embodiment, the rolling phenomenon hardly occurs in comparison with the comparative example described later. This will be described with reference to FIG. 4.

Figure 4B:
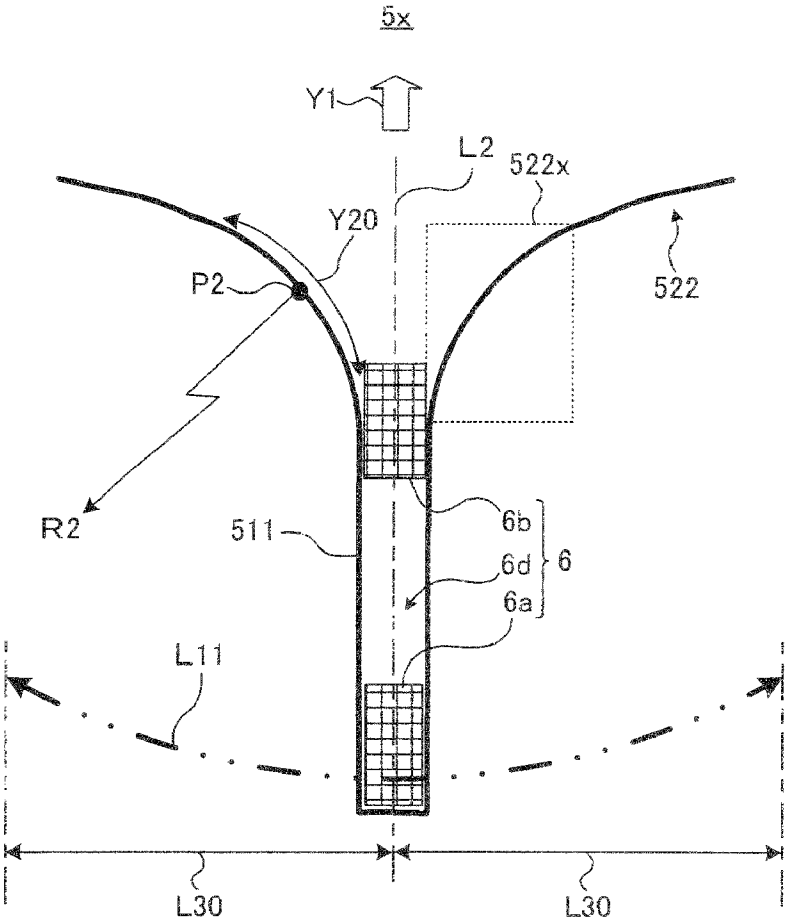
FIGS. 4A and 4B are sectional views of the diaphragm for explaining the operation of the diaphragm according to a comparative example and the embodiment.
Figure 4A:
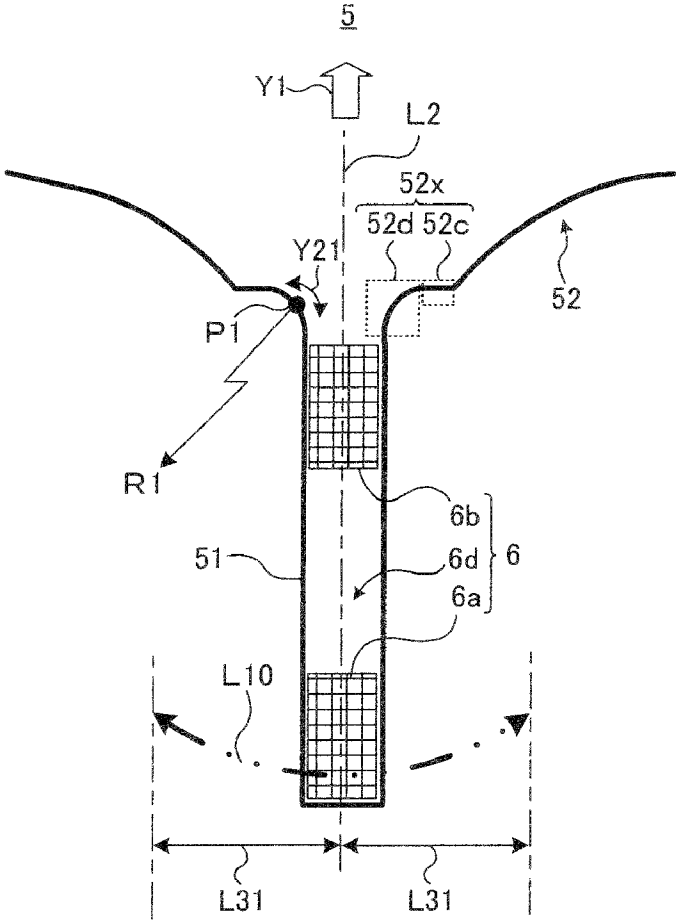

FIG. 4A is a major part sectional view of the diaphragm 5 according to the embodiment along the direction of the short axis L21, and is particularly an explanatory view of the movement of the diaphragm 5 at the time of driving the speaker 100. FIG. 4B is a major part sectional view of the diaphragm 5*x* according to the comparative example along the direction of the short axis L21, and is particularly an explanatory view of the movement of the diaphragm 5*x* at the time of driving the speaker.

First, the configuration of the diaphragm 5*x* according to the comparative example will be briefly described. Hereinafter, the same element to the diaphragm 5 of the embodiment is indicated by the same reference numeral and its explanation will be omitted.

The diaphragm 5*x* of the comparative example includes a voice coil supporting part 511 for supporting the voice coil 6, a sound radiating part 522 having a role of radiating sound wave and an attaching part 53 (not shown) to be attached to the attached part 4*a* of the frame 4. The inner circumferential end 522*x* (surrounded by the broken line) of the sound radiating part 522 has a curving shape, in section, curving toward the inner side (central axis L2 side) of the voice coil supporting part 511. For the convenience in explanation, "the inner circumferential end 522*x*" of the sound radiating part 522 will be hereinafter referred to as "curving part 522*x*" of the sound radiating part 522.

In comparing the diaphragm 5*x* of the comparative example with the diaphragm 5 of the embodiment, as shown in FIGS. 4A and 4B, the radius R2 of curvature of the curving part 522*x* of the sound radiating part 522 according to the comparative example is larger than the radius R1 of the curvature of the curving part 52*d* of the diaphragm 5 of the sound radiating part 522 according to the embodiment. Further, the curving part 522*x* of the sound radiating part 522 according to the comparative example is different from the curving part 52*d* of the diaphragm 5 in that the curving part 522*x* does not have the stepped part 52*c* provided at the inner circumferential end 52*x* of the sound radiating part 52 according to the embodiment. Therefore, in the diaphragm 5*x* according to the comparative example, the movable range of the voice coil support part 51*x* is defined by the carving part 522*x*.

In the comparative example having the above-described configuration, as shown in FIG. 4B, when the voice coil 6 moves in the sound radiating direction Y1 or its opposite direction at the time of diving the speaker device, the voice coil supporting part 511 moves in a manner drawing the arc L11, with using the radius R2 of curvature of the curving part 522*x* of the sound radiating part 522 as the substantial radius and using the substantial center P2 of the curving part 522*x* in the curving direction Y20 as the origin.

Here, the diaphragm 5*x* of the comparative example has the large radius R2 of curvature of the curving part 522*x* of the sound radiating part 522, and does not have the stepped part 52*c* which is provided at the inner circumference 52*x* side of the sound radiating part 52 of the embodiment. Therefore, when the diaphragm 5*x* vibrates, the rolling width L30 of the voice coil supporting part 511 in the short axis direction becomes large. Thus, in the speaker device having the diaphragm 5*x* of the comparative example, there is a problem that the voice coil supporting part 511 collides with the magnetic circuit 30 (not shown) to generate abnormal sound due to the occurrence of the rolling phenomenon.

In contrast, in the embodiment, the sound radiating part 52 has, at its inner circumferential side 52*x*, a stepped part 52*c* having a face substantially perpendicular to the sound radiating direction Y1, and a curving part 52*d* having a curving shape, in section, curving from one end (inner circumferential side) of the stepped part 52*c* toward the inner side of the voice coil support part 51.

Therefore, in the diaphragm 5 of the embodiment, the movable range of the voice coil supporting part 51 is defined by the stepped part 52*c* and the curving part 52*d*. Therefore, in the embodiment, as shown in FIG. 4A, the substantial center P1 of the curving part 52*d* in the curving direction Y21 serves as the origin of the movement of the voice coil support part 51 at the time of driving the speaker device 100. Namely, when the voice coil 6 moves in the sound radiating direction Y1 or its opposite direction, the voice coil support part 51 is movable in a manner drawing the arc L10, with using the radius R1 (<R2) of curvature of the curving part 52*d* of the sound radiating part 52 as the substantial radius and using the substantial center P1 of the curving part 52*d* in the curving direction Y21 as the origin. Therefore, in the embodiment, every if the rolling phenomenon occurs, it is possible to remarkably reduce the rolling width of the voice coil supporting part 51 and reducing the rolling, thereby suppressing the occurrence of the rolling phenomenon. Namely, in the embodiment, the movable range of the voice coil supporting part 51 in the direction of the short axis L21 of the diaphragm 5, i.e., the rolling width L31 (< the rolling width L30 of the comparative example) can be remarkably small, and the rolling phenomenon hardly occurs. As a result, the embodiment can prevent that the voice coil supporting part 51 collides with the magnetic circuit 30 and that abnormal sound is generated.

In the diaphragm 5 according to the embodiment, the sound radiating part 52 has a shape curving toward the sound radiating direction Y1. Further, at the outer circumferential end of the sound radiating part 52, the attaching part 53 to be attached to the attached part 4*a* of the frame 4 is provided. Still further, as shown in FIG. 3, the top part 52*a* of the sound radiating part 52 is arranged on the outside of the straight line L5 passing through the center of the sound radiating part 52. It is noted that, in the sound radiating part 52, the straight line L5 passes through the center of the line L4, which connects the (center) line L2 passing through the substantial center of the voice coil supporting part 51 with the line L3 passing through the substantial center of the attaching part 53.

By this, the effective vibrating area (the area of the sound radiating part 52 substantially contributing to the vibration) in the diaphragm 5 becomes large, and the output sound pressure level can be large. In addition, the compliance (an inverse number of the stiffness of the diaphragm 5) becomes large, and the minimum resonant frequency 10 can be lowered.

Further, in the diaphragm 5 according to the embodiment, the sound radiating part 52 has the shape including the long axis L20 and the short axis L21, and the reinforcing ribs 52*r* are formed on the sound radiating part 52 from the long axis L20 or the short axis L21 to the outer circumferential end of the sound radiating part 52. Thereby, the compliance of the diaphragm 5 in the vibrating direction (the sound radiating direction Y1) of the diaphragm 5 becomes large, and the minimum resonance frequency F0 can be lowered. Also, the stiffness of the diaphragm 5 in the direction of the long axis L20 becomes large, and the rolling phenomenon can be suppressed.

It is noted that, in a preferred embodiment, the reinforcing rib 52*r* has a shape depressed in the direction opposite to the sound radiating direction Y1 (or in the sound radiating direction Y1), as shown in FIG. 3. Also, the reinforcing ribs 52*r* provided in the direction of the short axis L21 have a shape symmetrical with respect to the long axis L20, and have a shape of extending obliquely with respect to the direction of the long axis L20. Also, the reinforcing ribs 52*r* provided in the direction of the long axis L20 have a shape symmetrical with respect to the short axis L21. In addition, out of the plural reinforcing ribs 52*r* provided in the direction of the long axis L20, at least one reinforcing rib 52*r* has a shape symmetrical with respect to the long axis 120 and extending obliquely with respect to the direction of the long axis L20. In the present invention, the shape of the reinforcing rib 52*r* and the number of the reinforcing ribs 52*r* provided on the sound radiating part 52 are not particularly limited.

[Application to Mobile Phone]

The description will be given of an example in which the speaker device 100 according to the embodiment of the invention is applied to a receiving unit and an incoming unit of a mobile phone.

Figure 5B:
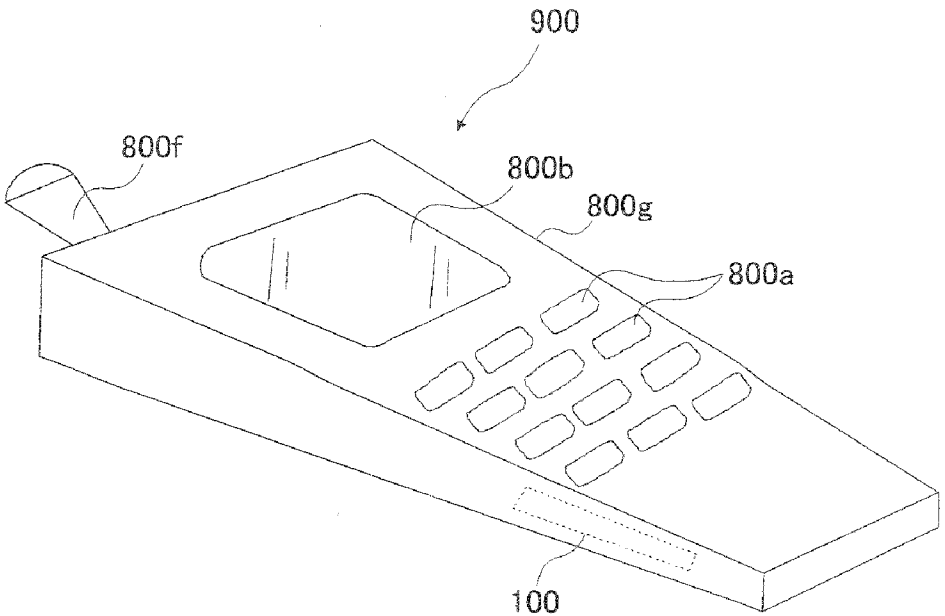
FIGS. 5A and 5B are a front view and a perspective view of a mobile phone which employs the speaker device according to the present invention.
Figure 5A:
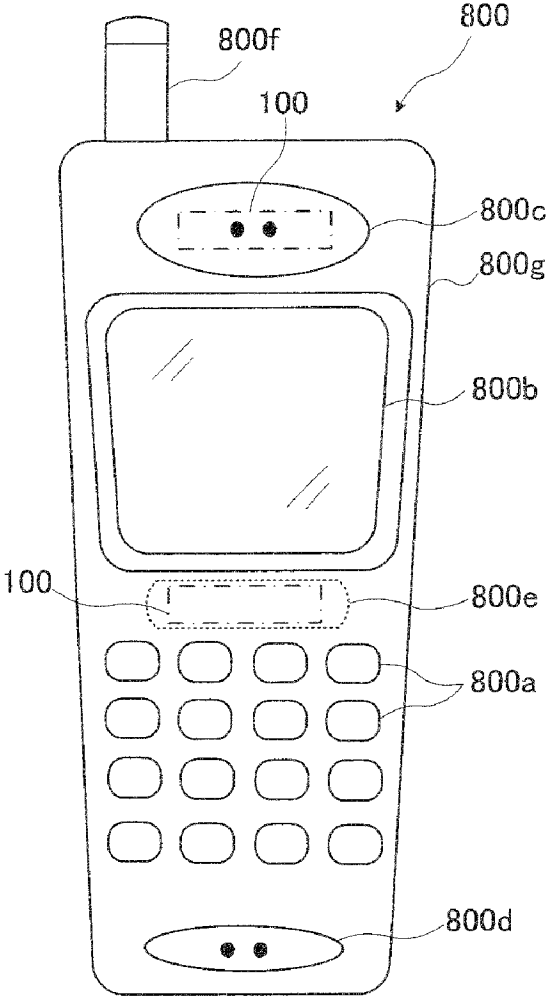

FIG. 5A is a schematic plane view showing the configuration of the mobile phone 800. The mobile phone 800 shown in FIG. 5A as an example includes a plurality of operation buttons 800*a* provided on the front face of a case 800*g*, a display unit 800*b* for displaying images, a receiving part 800*c*, a sending part 800*d*, an incoming unit 800*e* provided on the back face of the case 800*g* and having a function of outputting incoming alarm sound, and a transmitting/receiving antenna 800*f* provided on one side face of the case 800*g*. In the mobile phone having the above-described configuration, the speaker devices 100 are installed in the case 800*f* and provided at the positions corresponding to the receiving part 800*c* and the incoming unit 800*e*, for example.

Further, in the present invention, the speaker device 100 can be provided on the side face of the mobile phone 900 as shown in FIG. 5B.

It is noted that, in the present invention, the speaker device 100 according to the embodiment of the invention can be preferably used in various mobile equipments other than the above-mentioned mobile phone.

INDUSTRIAL APPLICABILITY

The present invention can be used as a speaker for a mobile equipment or a micro-speaker loaded on an electrical equipment.

The invention claimed is:

1. A diaphragm comprising:

a voice coil supporting part which supports a voice coil; and a sound radiating part formed to be connected to an end of the voice coil supporting part, wherein the voice coil supporting part has a shape extending in a direction opposite to a sound radiating direction, and wherein the sound radiating part comprises a stepped part having a face substantially perpendicular to the sound radiating direction, and a curving part having a curving sectional shape curving from an end of the stepped part toward an inside of the voice coil supporting part.

2. The diaphragm according to claim 1, wherein the sound radiating part having a shape curving toward the sound radiating direction, wherein an attaching part to be attached to an attached part is provided at an outer circumferential end of the sound radiating part, and wherein a top of the sound radiating part is positioned outside of a center of the sound radiating part.

3. The diaphragm according to claim 1, wherein the sound radiating part has a shape including a long axis and a short axis, and wherein a reinforcing rib is formed on the sound radiating part from one of the long axis and the short axis toward an outer circumferential end of the sound radiating part.

4. A speaker device comprising:

a diaphragm comprising; a voice coil supporting part which supports a voice coil; and a sound radiating part formed to be connected to an end of the voice coil supporting part; and a magnetic circuit, wherein the voice coil supporting part is positioned at a center of the magnetic circuit, wherein the voice coil supporting part has a shape extending in a direction opposite to a sound radiating direction, and wherein the sound radiating part comprises a stepped part having a face substantially perpendicular to the sound radiating direction, and a curving part having a curving sectional shape curving from an end of the stepped part toward an inside of the voice coil supporting part.

5. A mobile equipment comprising the speaker device according to claim 4.

* * * * *